US005937487A

United States Patent [19]

Bauer

[11] Patent Number: 5,937,487

[45] Date of Patent: Aug. 17, 1999

[54] MAGNETIC SLIDE FASTENER

[76] Inventor: Irving Bauer, 1624 Webster Ave., Bronx, N.Y. 10457

[21] Appl. No.: 09/060,763

[22] Filed: Apr. 15, 1998

[51] Int. Cl.[6] ..... A44B 21/00

[52] U.S. Cl. ..... 24/303; 24/66.1; 292/251.5

[58] Field of Search ..... 24/303, 66.1, 658, 24/688; 292/251.5

[56] References Cited

U.S. PATENT DOCUMENTS

| | | | |
|---|---|---|---|
| D. 247,467 | 3/1978 | Morita | D8/331 |
| D. 247,468 | 3/1978 | Morita | D8/331 |
| 3,041,697 | 7/1962 | Budreck | 24/303 |
| 4,021,891 | 5/1977 | Morita | 24/201 B |
| 4,200,852 | 4/1980 | Aoki | 335/285 |
| 4,453,294 | 6/1984 | Morita | 24/303 |
| 4,700,436 | 10/1987 | Morita | 24/303 |
| 5,125,134 | 6/1992 | Morita | 24/303 |
| 5,142,746 | 9/1992 | Morita | 24/303 |
| 5,197,168 | 3/1993 | Levy | 24/303 |
| 5,199,138 | 4/1993 | Morita | 24/303 |
| 5,249,338 | 10/1993 | Aoki | 24/303 |
| 5,251,362 | 10/1993 | Riceman et al. | 24/303 |
| 5,253,394 | 10/1993 | Morita | 24/303 |
| 5,274,889 | 1/1994 | Morita | 24/303 |
| 5,349,725 | 9/1994 | Levy | 24/303 |
| 5,367,891 | 11/1994 | Furuyama | 63/29.2 |
| 5,369,899 | 12/1994 | Reeves | 40/1.5 |
| 5,370,582 | 12/1994 | Campbell | 464/170 |
| 5,377,392 | 1/1995 | Morita | 24/303 |
| 5,379,495 | 1/1995 | Riceman et al. | 24/305 |
| 5,392,497 | 2/1995 | Defner | 24/303 |
| 5,400,479 | 3/1995 | Medina et al. | 24/303 |
| 5,409,275 | 4/1995 | Yoshida et al. | 292/251.5 |
| 5,425,160 | 6/1995 | Krapf | 24/67 R |
| 5,428,873 | 7/1995 | Hitchcock et al. | 24/303 |
| 5,432,986 | 7/1995 | Sexton | 24/303 |
| 5,448,806 | 9/1995 | Riceman et al. | 24/303 |
| 5,450,658 | 9/1995 | Hicks | 24/303 |
| 5,473,799 | 12/1995 | Aoki | 24/303 |
| 5,515,581 | 5/1996 | Kaufmann | 24/303 |
| 5,518,784 | 5/1996 | Fussell | 428/7 |
| 5,541,790 | 7/1996 | Bleeke | 360/105 |
| 5,545,157 | 8/1996 | Van Iten | 604/385.1 |
| 5,560,089 | 10/1996 | Morita | 24/303 |
| 5,572,772 | 11/1996 | Morita | 24/303 |
| 5,572,773 | 11/1996 | Bauer | 24/303 |
| 5,572,887 | 11/1996 | Geswelli | 63/3 |
| 5,604,960 | 2/1997 | Good | 24/303 |
| 5,611,120 | 3/1997 | Riceman et al. | 24/303 |
| 5,611,689 | 3/1997 | Stemmann | 433/189 |
| 5,618,071 | 4/1997 | Aoki | 292/251.5 |
| 5,630,258 | 5/1997 | Schneider | 24/303 |
| 5,647,101 | 7/1997 | Morita | 24/303 |
| 5,664,298 | 9/1997 | Nessar-Ivanovic | 24/303 |
| 5,675,874 | 10/1997 | Chen | 24/303 |
| 5,676,600 | 10/1997 | Campbell | 464/170 |
| B1 4,021,891 | 8/1986 | Morita | 24/303 |
| B1 4,453,294 | 5/1991 | Morita | 24/303 |
| B2 4,021,891 | 9/1987 | Morita | 24/303 |
| B2 4,453,294 | 7/1996 | Morita | 24/303 |

*Primary Examiner*—Victor N. Sakran
*Attorney, Agent, or Firm*—Abelman, Frayne & Schwab

[57] ABSTRACT

A magnetic fastener is disclosed of the type which has particular utility for handbags. The magnetic fastener includes a manually releasable lock which acts in conjunction with the magnetic attraction between its respective members to maintain the fastener in its closed condition. A manually actuable slide is provided to release the locking engagement and permit opening of the magnetic fastener.

18 Claims, 7 Drawing Sheets

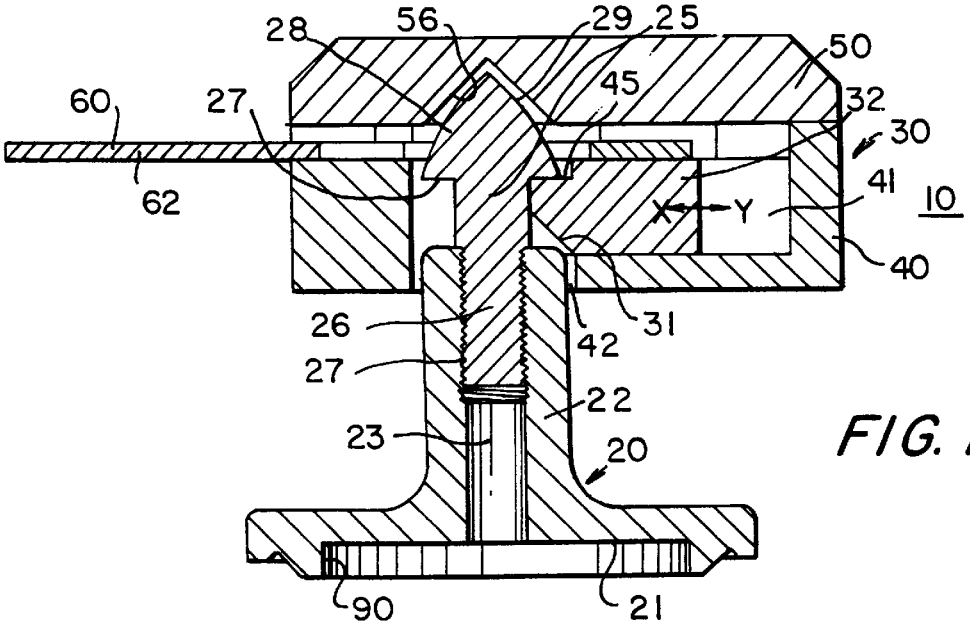
FIG. 1
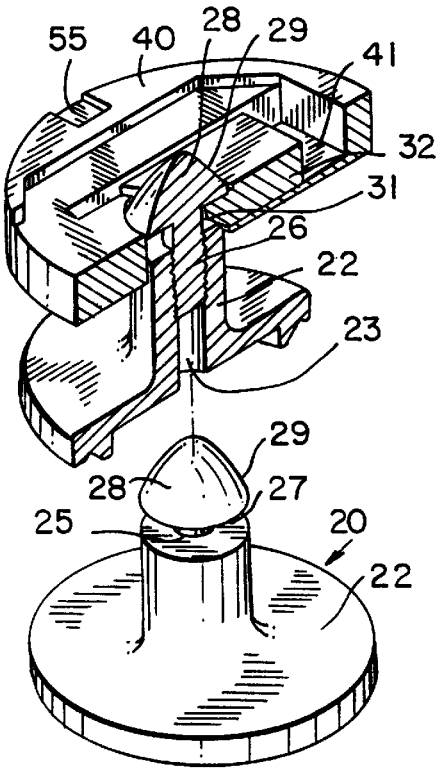
FIG. 2
FIG. 3
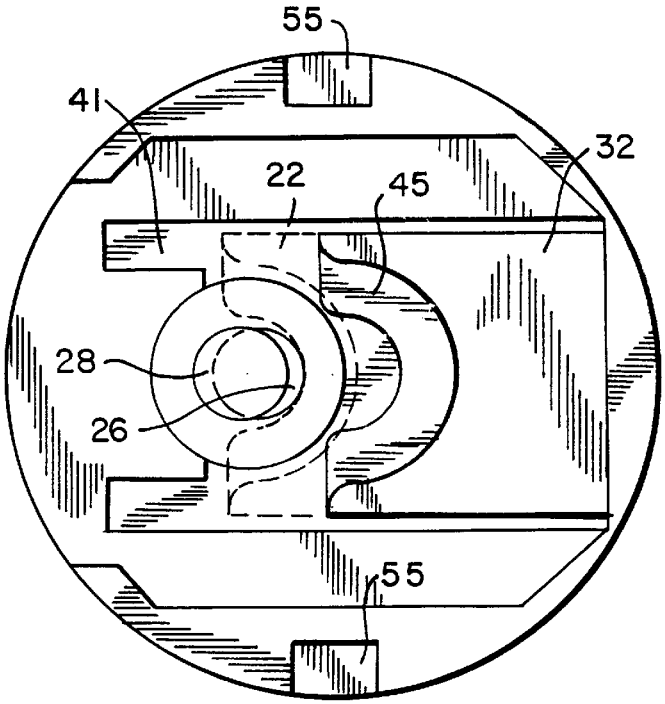

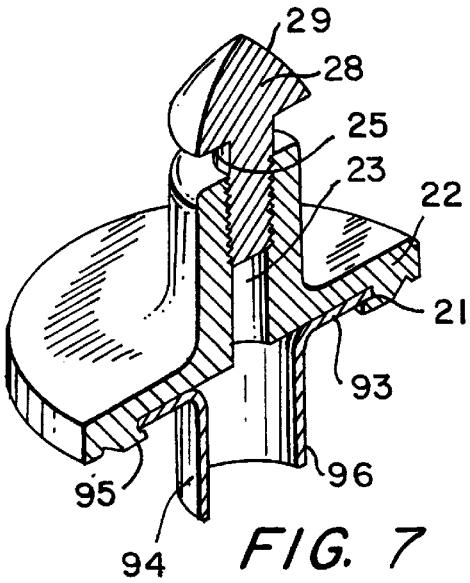
FIG. 7
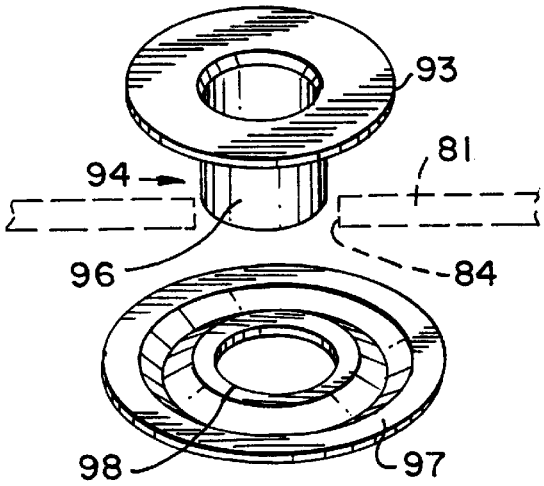
FIG. 8
FIG. 9
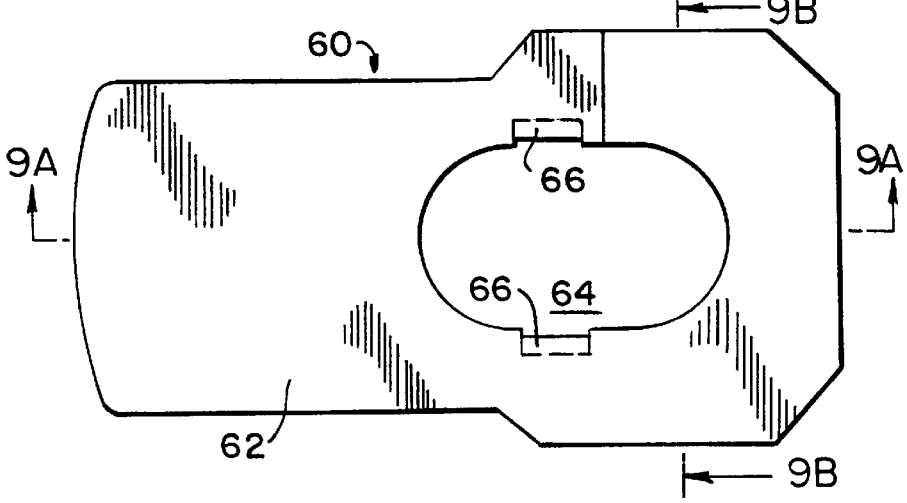
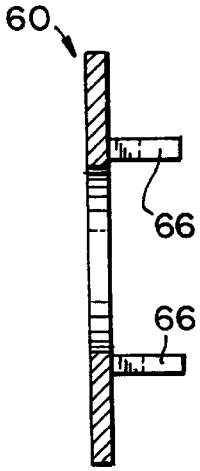
FIG. 9B
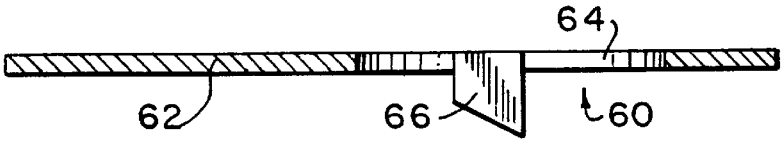
FIG. 9A

MAGNETIC SLIDE FASTENER

FIELD OF INVENTION

The present invention relates to a magnetic fastener having particular utility in conjunction with the closure flap of a handbag. The magnetic fastener utilizes the attractive forces between a permanent magnet in one assembly, and a ferromagnetic member in the other assembly to provide a magnetic and mechanically locked engagement therebetween. The locking engagement between the permanent magnet and the ferromagnetic member may then be manually released upon relative sliding movement therebetween as the two assemblies are separated.

BACKGROUND OF THE INVENTION

The present fastener is a variation of the general type of magnetic fastener shown in U.S. Pat. Nos. 4,021,891; 4,453,294; and 5,274,889, and more particularly, an improvement of the magnetic slide type fasteners shown in U.S. Pat. Nos. 5,199,138; 5,253,394; 5,377,392; 5,515,581; and 5,572,772. The magnetic fasteners disclosed in U.S. Pat. Nos. 4,021,891; 4,453,299; and 5,274,889 include cooperating female and male member assemblies. The female member typically includes a permanent magnet, a ferromagnetic member at one of its poles, and appropriate cover means for protectively enclosing the permanent magnet and controlling the magnetic flux paths. The male member assembly includes a cooperating ferromagnetic member which upon proximity between the two members will be magnetically attracted to the female member assembly to provide for a proper positioning and centering of the interengaged male and female member assemblies. The permanent magnet of the female assembly includes a central opening for receiving, and appropriately positioning, a projecting ferromagnetic portion of the male member. The particular selection and configuration of the ferromagnetic and nonferromagnetic portions of such magnetic assemblies have varied in accordance with the particular requirements and design of their intended applications. Although widely successful, fasteners of this type are maintained in their closed position solely by magnetic attraction.

It has been previously proposed in U.S. Pat. Nos. 5,199,138; 5,253,394; 5,377,392; 5,515,581; and 5,572,772 to provide for a sliding manually defeatable mechanical locking engagement between the male and female members, in addition to their magnetic attraction. Those magnetic fasteners have generally included a permanent magnet projecting outward of the male assembly having a detent for engaging a sliding ferromagnetic plate, or plates, within the female assembly. The male assembly may then typically be attached to the body of a handbag. Since the permanent magnet of the male assembly is not shielded, such fasteners may disadvantageously cause some erasure of magnetic encoding on credit cards which are typically stored in handbags, or other articles intended to utilize such magnetic fasteners. Further, the attached magnetic closures disclosed therein are relatively complex, large, and utilize a multiplicity of parts resulting in manufacturing complexities and high costs, limiting their commercial utility. The excessive size and other disadvantages of the magnetic fasteners disclosed in U.S. Pat. Nos. 5,199,138; 5,253,394; and 5,377,392 is reviewed in U.S. Pat. No. 5,572,772, of the same inventor. These previously proposed magnetic slide fasteners all utilized a rectangular forwarding projecting male member and a similarly configured female aperture, requiring precise alignment in the installation of the two assemblies on the handbag. Further, the female assemblies shown in U.S. Pat. Nos. 5,199,138; 5,293,394; 5,377,392; and 5,572,772 could only be secured to the lip of a handbag flap, tending to limit their practical utilization.

SUMMARY OF THE INVENTION

The magnetic fastener of the present invention provides for a manually defeatable mechanical lock in the closed condition, in an extremely simple manner, and with a minimum of parts. The female assembly includes a magnetically shielded permanent magnet located within an interior chamber of its housing, and is free to laterally slide therein. The female assembly includes an opening, for receiving the similarly shaped forwardly projecting end of the cooperating male ferromagnetic member. As the male member enters the opening of the female assembly the permanent magnet will slide into engagement with the male member by virtue of the magnetic attractive forces. The initially engaged surfaces of the male and female members are configured to provide a cam-type action which slides the permanent magnet away from the male ferromagnetic member in opposition to their magnetic attractive forces. At the termination of this cam-type engagement, a recessed undercut is provided within the male member, permitting the permanent magnet to reverse its direction, sliding towards the male ferromagnetic member, where a cooperate annular recess within the top of the permanent magnet mechanically engages the undercut of the permanent magnet. Such mechanical engagement is preferably over at least half the circumference of the undercut, and prevents the separation of the male and female members by the mere attempt to pull them apart.

In order to separate the male and female members, and hence open the magnetic closure, it is necessary to slide the permanent magnet out of its mechanical engagement with the undercut of the male magnetic member. Such disengagement, and hence opening of the magnetic fasteners assembly, is achieved by a slide member, which includes a handle laterally projecting out of the female assembly. The handle may be manually moved to defeat such mechanical engagement. Hence, to open the magnetic fastener, the slide must first be moved, and the parts thereafter pulled apart.

Recognizing that such magnetic fasteners have found particular utility in conjunction with handbags, where one of the assemblies (typically the male) is mounted to the body of the handbag, and the other cooperating assembly (female) is carried by the closure flap of the handbag, the mechanical lock of the present invention provides enhanced security against inadvertent opening (or pilfering) of the handbag. Further, as the handbag is closed, with the permanent magnet reversing its direction at the termination of its cam-type engagement with the male member, there will preferably be an audible click as the mechanical lock is engaged, thereby advising the user that the closure has been completed.

To provide for magnetic shielding of the permanent magnet, it is enclosed within a housing formed of nonmagnetic material, and the slide actuator which projects outward of the female assembly is also preferably formed of non magnetic material.

In order to enhance the versatility of the aesthetic compatibility between the magnetic fastener and the article to which it is attached, the housing of the female member is adapted to receive a variety of decorative covers in a simple snap fit manner. This will readily permit customizing of the magnetic closure to be appropriately color, or otherwise, coordinated to the particular article to which it is to be attached.

As a particularly advantageous aspect of the present invention, in addition to providing increased security of closure, a minimum of easily manufactured and assembled parts are utilized, thereby resulting in a low cost magnetic fastener.

It is therefore a primary object of the present invention to provide a compact magnetic fastener which also includes a mechanical lock to maintain its closed condition.

An additional object is to provide a magnetically shielded slide type magnetic fastener.

Another object of the present invention is to provide such a magnetic fastener in which the mechanical lock is defeated by the sliding movement of the permanent magnet.

A further object of the present invention is to provide such a magnetic fastener in which the mechanical locking engagement in the closed condition is automatically achieved during the magnetic engagement of the male and female assemblies.

Yet another object of the present invention is to provide such a magnetic fastener in which the automatic mechanical engagement is achieved by camming action between the permanent magnet, contained in the female assembly, and the cooperating male member contained in the male assembly, which moves the permanent magnet in a lateral direction during closure of the magnetic fastener to achieve the desired locking engagement.

Yet another object of the present invention is to provide such a magnetic fastener which includes a minimum of low cost, easily assembled, components.

These as well as other objects of the present invention will become apparent upon a consideration of the following detailed description and drawings.

BRIEF DESCRIPTION OF THE DRAWINGS

FIG. 1 is a cross sectional view of the principal components of the magnetic fastener shown in the operative, closed condition.

FIG. 2 is a partial cutaway perspective view showing the closed condition, corresponding to FIG. 1, but with the top portion of the female housing, and the manual slide member being deleted to show the interior details.

FIG. 3 is a top view of the female assembly, with the top portion of its housing removed, and the permanent magnet shown in its unlocked condition in solid lines, and locked in dotted lines.

FIG. 7 is a cutaway perspective view of the male assembly.

FIG. 8 shows the manner in which the male assembly may typically be connected to the handbag.

FIGS. 9–9B show details of the slide release contained within the female assembly. FIG. 9 is a top view, FIG. 9A a section along line A—A of FIG. 9 and FIG. 9B, a section along line B—B of FIG. 9.

FIG. 12 is a bottom view thereof. FIG. 12D is a cross sectional view as shown by the line D—D of FIG. 12A.

DETAILED DESCRIPTION

Figure 4A:
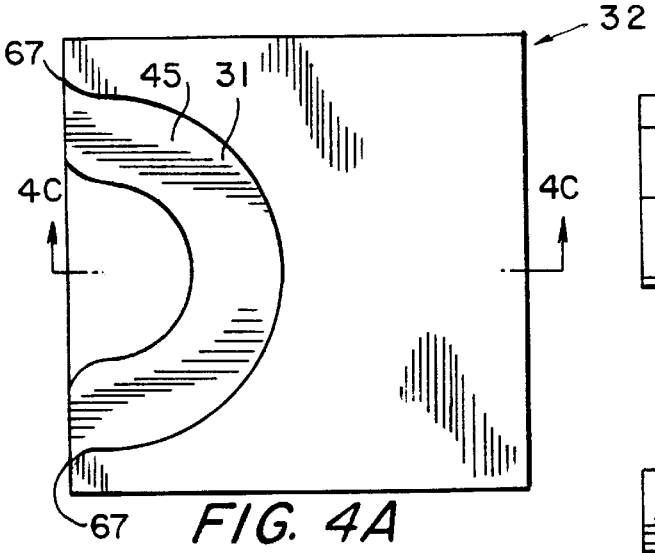
FIGS. 4A–4D show details of the slidable permanent magnet located within the female assembly, with FIG. 4A being a top view thereof, FIG. 4B being a front view, FIG. 4C a cross sectional view, along the line C—C as shown in FIGS. A, and 4D being an isometric front view.
Figure 4C:
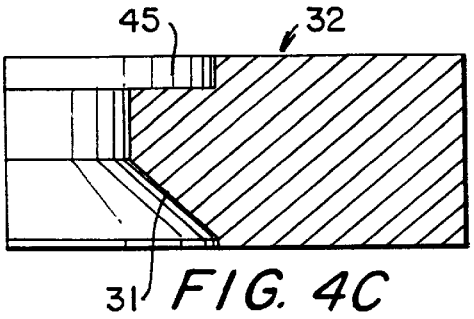
Figure 4B:
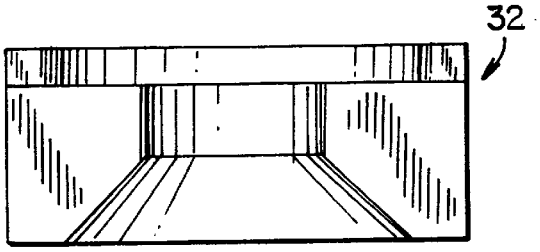
Figure 4D:
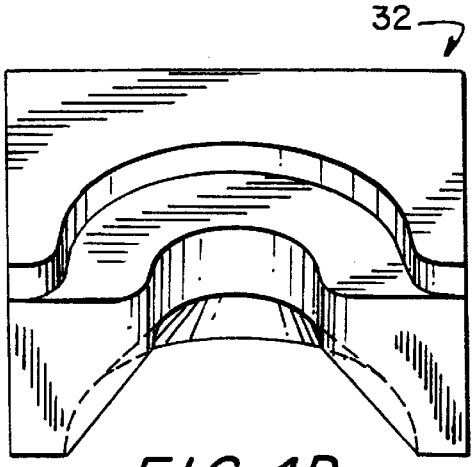
Figure 5:
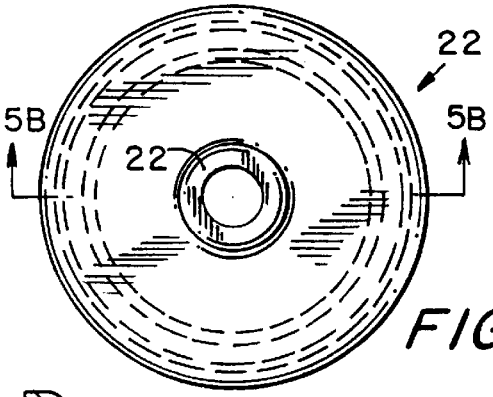
FIGS. 5, 5A, and 5B show details of the male housing member, with FIG. 5 being a top view thereof, FIG. 5A a side view, and FIG. 5B a cross sectional view along the line B—B as shown in FIG. 5.
Figure 5A:
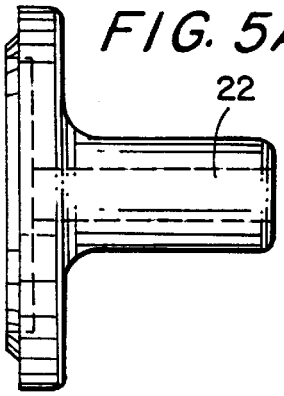
Figure 5B:
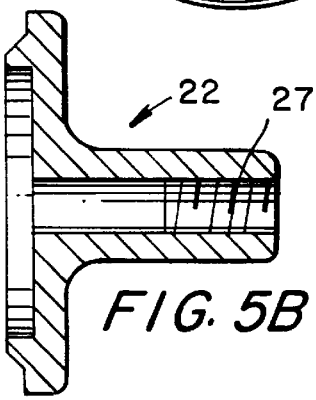
Figure 6A:
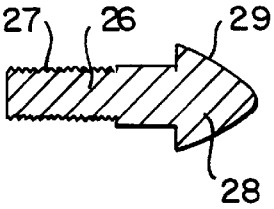
FIGS. 6 and 6A are side and cross sectional views of the male ferromagnetic member.
Figure 6:
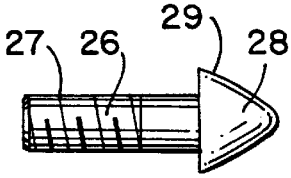

Reference is initially made to FIGS. 1–3 which show the general operation of a magnetic fastener in accordance with the present invention. The magnetic fastener 10 includes a male assembly 20 and female assembly 30. The male assembly 20 shown in this embodiment includes a non-ferromagnetic housing member 22, which may typically be die cast of a zinc and lead alloy, or other metal, but could alternatively be molded of plastic. Housing member 22 includes a central opening 23 for securably retaining a projecting male ferromagnetic member 25, which may be typically formed of steel. The ferromagnetic member 25 includes a shank portion 26, which cooperatively engages the interior of housing opening 23, as shown by the threaded engagement 27 of FIGS. 5 and 6. The forward portion 28 of ferromagnetic male member 25, which preferably has a circular cross-section, includes an arcuate surface 29 which, as will be subsequently discussed, is designed to engage surface 31 of the permanent magnet 32 in a cam-like manner.

The male housing 20 also includes a recess 21 at its bottom which, as will be discussed in conjunction with FIGS. 7 and 8, is configured to receive an appropriate mechanism for attaching the male assembly to its intended article, such as a handbag.

Figure 11B:
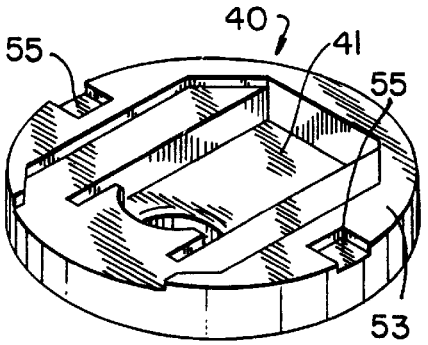
FIG. 11 is a top view of the female assembly lower housing member.
FIG. 11A is a cross section of FIG. 11 along the line A—A shown therein.
Figure 11B:
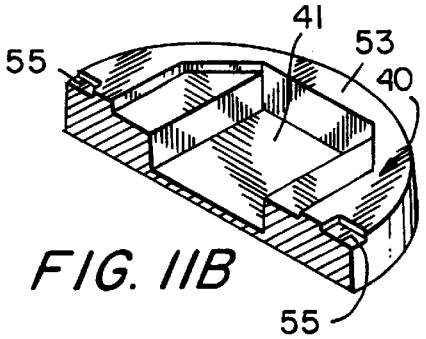
Figure 11:
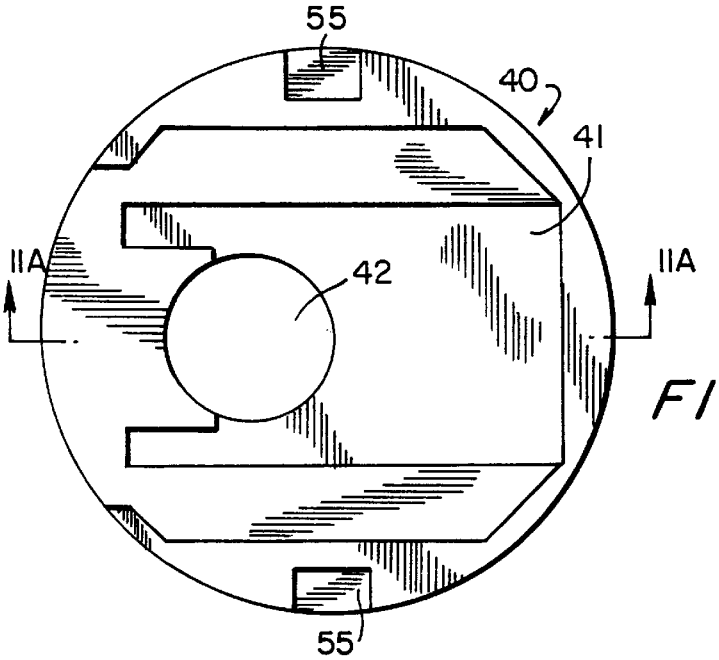
Figure 11A:
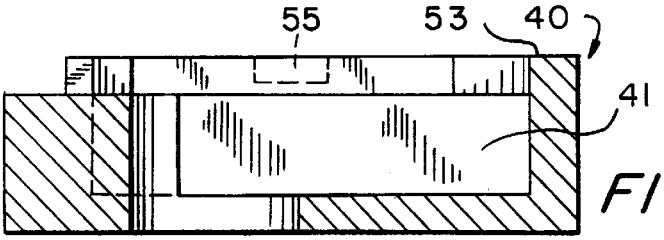

The female assembly 30 includes lower housing section 40 and upper housing section 50, each of which is formed of non magnetic material, preferably die cast of a zinc and lead alloy. Alternatively one or both of the housing sections may be brass, plastic or other non-magnetic material. Lower housing section 40 includes an interior chamber 41 (see FIGS. 11–11B) which is adapted to receive permanent magnet 32 and permit lateral sliding thereof as shown by the arrows X and Y of FIG. 1. Lower housing section 50 includes an opening 42 along its bottom wall which is configured to receive the forward end of male housing 20, as shown in FIG. 1. As the male assembly enters opening 42 of the female assembly, with ferromagnetic member 25 initially projecting into opening 41, the permanent magnet 32, which is free to slide in interior chamber 41, will move to the left, as shown by arrow X, into engagement with the forwardmost extreme of camming surface 29. As the male member 25 is moved forward, the continued engagement between surfaces 29 and 31 will move the slide member to the right, as shown by arrow Y, opposing the magnetic attraction therebetween. Such movement to the right will continue until the ferromagnetic member 29 moves to position shown in FIG. 1, at which time an annular recessed ledge 45 of the permanent magnet 32 translates along undercut 27 at the terminus of cam surface 29, thereby permitting the permanent magnet 32 to move into the locked condition shown in FIG. 1. As shown by the dotted condition of FIG. 3, such engagement is generally C-shaped about the circumference of the male member, and is preferably at least over half the circumference. Such movement may be associated with an audible indication, thereby advising the user that the magnetic fastener is fully closed, and in its secure locked engagement.

FIGS. 7 and 8 show a typical manner in which the male assembly may be secured to the handbag. A recessed opening 21 is provided at the lower extreme of housing 22 for receiving the annular portion 93 of a grommet 94. Grommet 94 will preferably be of non magnetic material, such as brass. A crimp ring 95 is provided for securably maintaining the engagement between grommet 94 and housing member 22. The shaft 96 of the grommet is then inserted through an opening 84 provided within the material of the article to which the male member is to be secured (see FIG. 15A). A spring type washer 97, preferably formed of non-magnetic material, is then inserted over shaft 96, with the diameter of opening 98 therein tightly engaging the outside diameter of shaft 96 for securably maintaining the male assembly 20.

Figure 10:
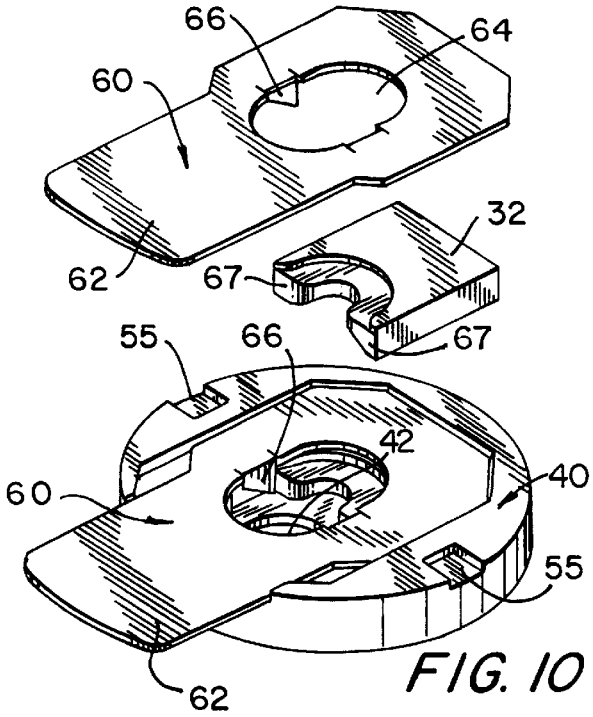
FIG. 10 is an exploded perspective showing the assembly of the permanent magnet, and manual slide release within the lower housing section of the female assembly.

When it is desired to open the magnetic fastener, it is necessary to move permanent magnet 32 to the right, as shown by the Y in FIG. 1, in order to defeat the mechanical engagement between 27–45. Such movement is provided by a manual slide release 60, the details of which are shown in FIGS. 9–9B, with its operation in conjunction with the magnet shown in FIG. 10. Slide release 60 is formed of non magnetic material, and may typically be brass. It includes a projecting manual handle portion 62, aperture 64 and folded down engagement ears 66. The engagement ears 66 contact the leftmost faces 67 of permanent magnet 32, thereby moving the permanent magnet 32 in the direction of arrow Y, as the slide member 60 is moved inwardly. This serves to effectively release the engagement between surfaces 27, 45 so that the magnetic fastener may be then opened.

Figure 12B:
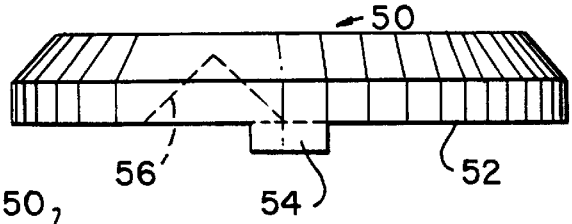
FIG. 12B is a side view thereof.
Figure 12:
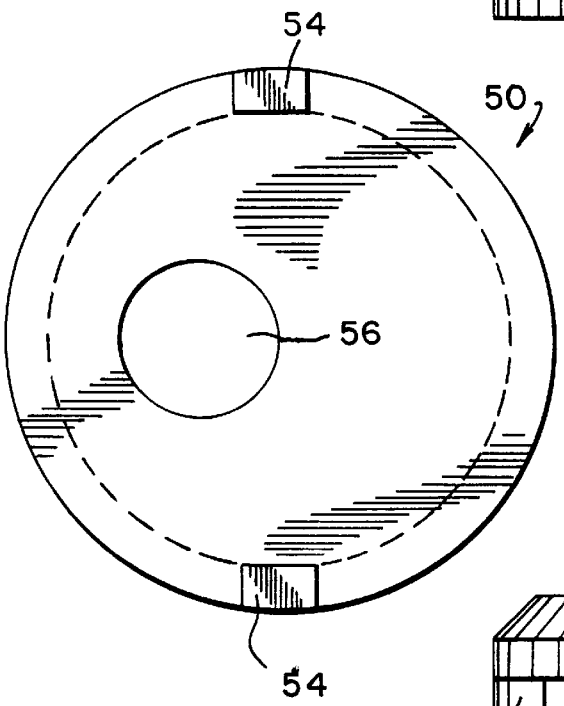
FIGS. 12–12D show details of the upper housing member of the female assembly.
Figure 12C:
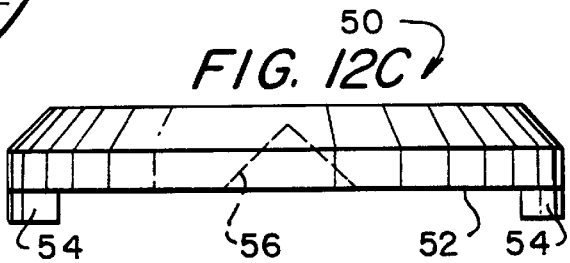
FIG. 12C is a front view thereof.
Figure 12D:
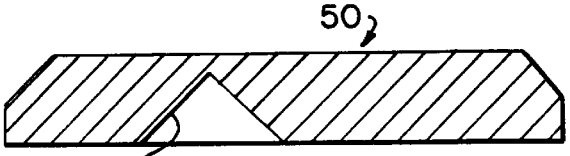
Figure 12A:
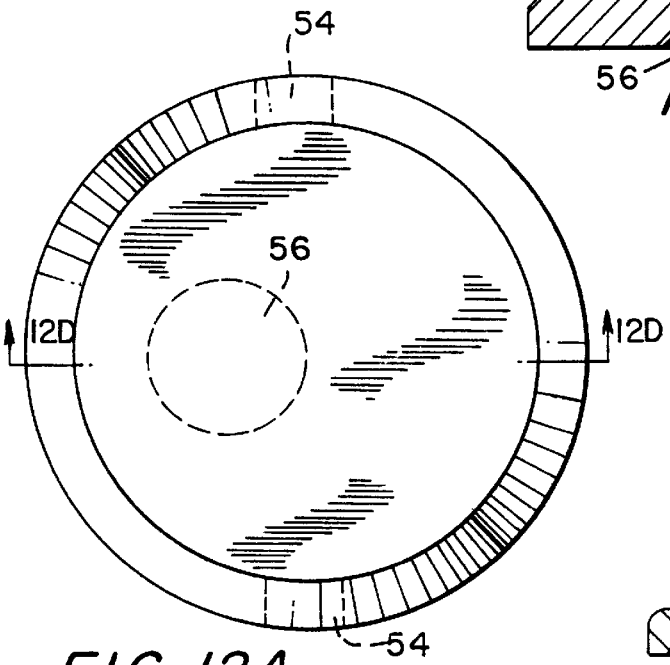
FIG. 12A is a top view thereof.

Reference is now made to FIGS. 12–12D which show the details of the upper female housing member 50. This housing member 50 includes a lower surface 52 which will mate with upper surface 53 of the lower housing member 40, and includes downwardly projecting ears 54 which are sized to tightly engage cooperating recesses 55 provided in lower housing member 40 (see FIGS. 10 and 11). An inverted V shaped notch 56 is provided to appropriately accommodate the forwardly projecting end of the male magnetic member 25, as best shown in FIG. 1.

Figure 15:
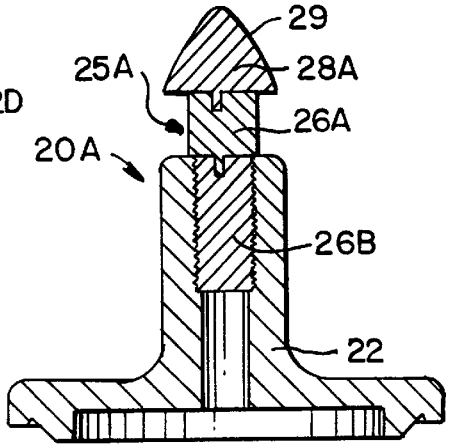
FIG. 15 is a cross-sectional view of an alternative male assembly.
Figure 13:
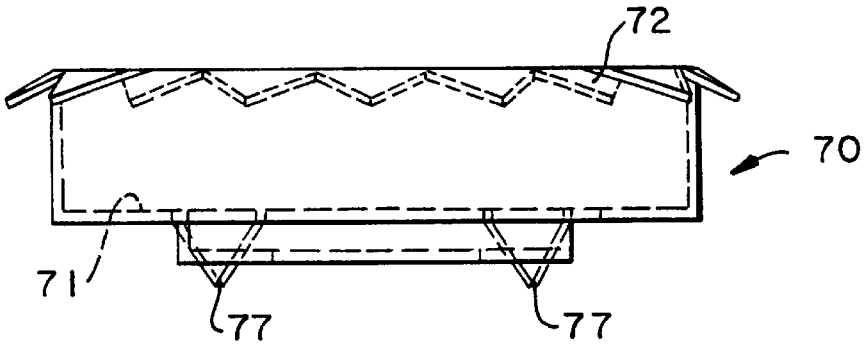
FIGS. 13 and 13A show a typical exterior cuplike receptacles for the female assembly, including stake members at its lower end for securement to the handbag flap, and spring-like members at its upper end for the reception of a decorative cover.
Figure 13A:
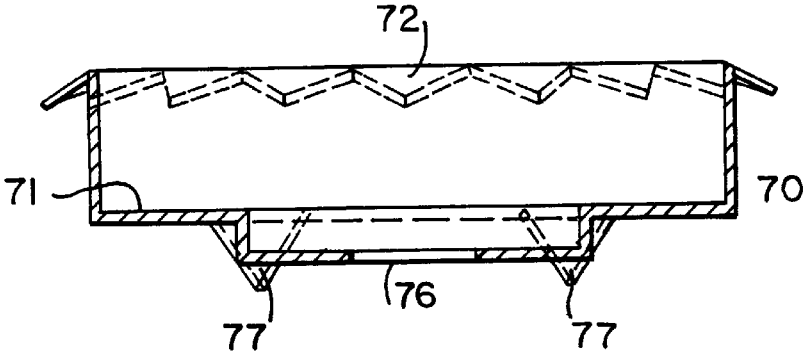
Figure 14:
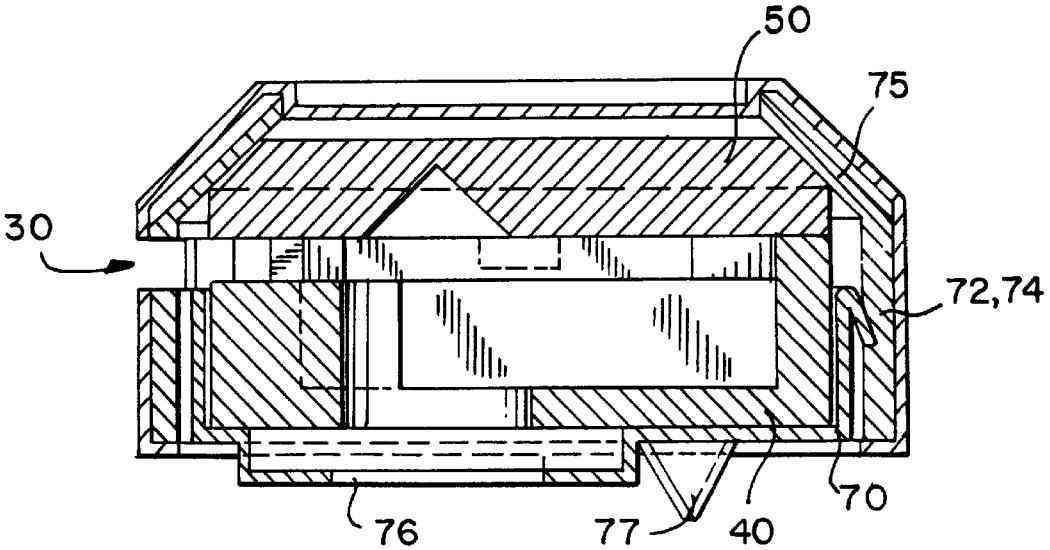
FIG. 14 shows the assembly of the female housing members within the receptacle of FIGS. 13 and 13A, but with the permanent magnet and slide deleted for simplification.

FIGS. 13, 13A, and 14 show the typical manner in which the female housing assembly 30 may be attached to the article containing same (such as a handbag shown in FIGS. 15 and 15A). The female assembly may be placed within a cuplike retaining member 70, preferably formed of non-magnetic material for additional magnetic shielding of permanent magnet 32. Cuplike retaining member 70 has an internal opening 71 which is configured to receive the female assembly 30, as shown in FIG. 14. Cuplike member 70 includes a circumferential series of saw tooth-like spring members 72, which are shaped to snap into complementary recesses 74 in a cover member 75. Cover member 75 will advantageously be of a material, and a color, to provide aesthetic coordination with the intended article. It can be formed of plastic or other materials, and will either be a color, or may be otherwise decorated, as disclosed in copending U.S. patent application Ser. No. 80/991,931, filed on Dec. 16, 1997, in the name of Irving Bauer, entitled "Magnetic Fastener." The cuplike member 70 may then be attached to the flap of a handbag by inserting a grommet (not shown) through opening 76 and securing same in the same general manner as shown in FIG. 8 above with respect to the attachment of male assembly. Stake like projections 77 are advantageously provided, to puncture the material of the handbag, so as to prevent rotation of the female assembly 30.

FIG. 15 shows an alternative configuration of the male assembly 20-A. The projecting part previously shown as 25, and formed of a ferromagnetic material, is now formed of three parts. The forward part 28A is made of a non-magnetic material, typically brass. Intermediate part 26A is ferromagnetic, typically steel, and lowermost shank portion 26 is non-magnetic typically of the same material as part 28A. The housing 22 will still be of a non-magnetic material.

As a further alternative, referring to FIG. 1, part 25 may be non-magnetic, typically brass, and housing 22 ferromagnetic, typically steel.

The simplified continuation of the recent invention permits a very low cost compact assembly. Typically, the female and male assembly may have a diameter in the order of 10–18 mm, with the cross sectional diameter of the male actuating member being in the order of 3–4 mm.

Figure 16:
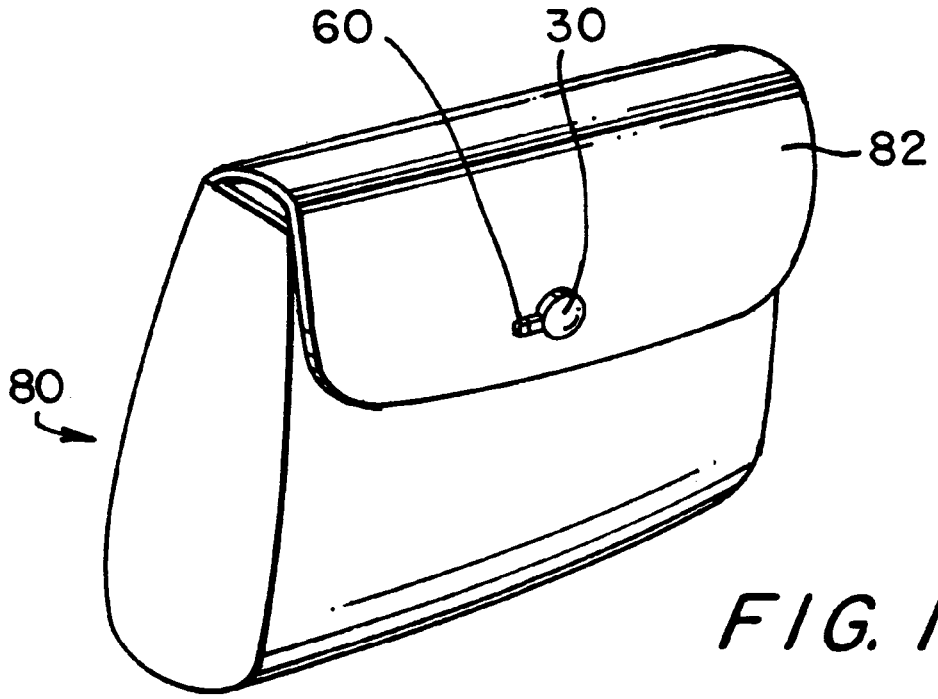
FIGS. 16 and 16A typically show the manner in which the magnetic fastener of the present invention may be utilized in conjunction with a handbag, with FIG. 16 showing the handbag in the closed condition, and FIG. 16A in the open condition.
Figure 16A:
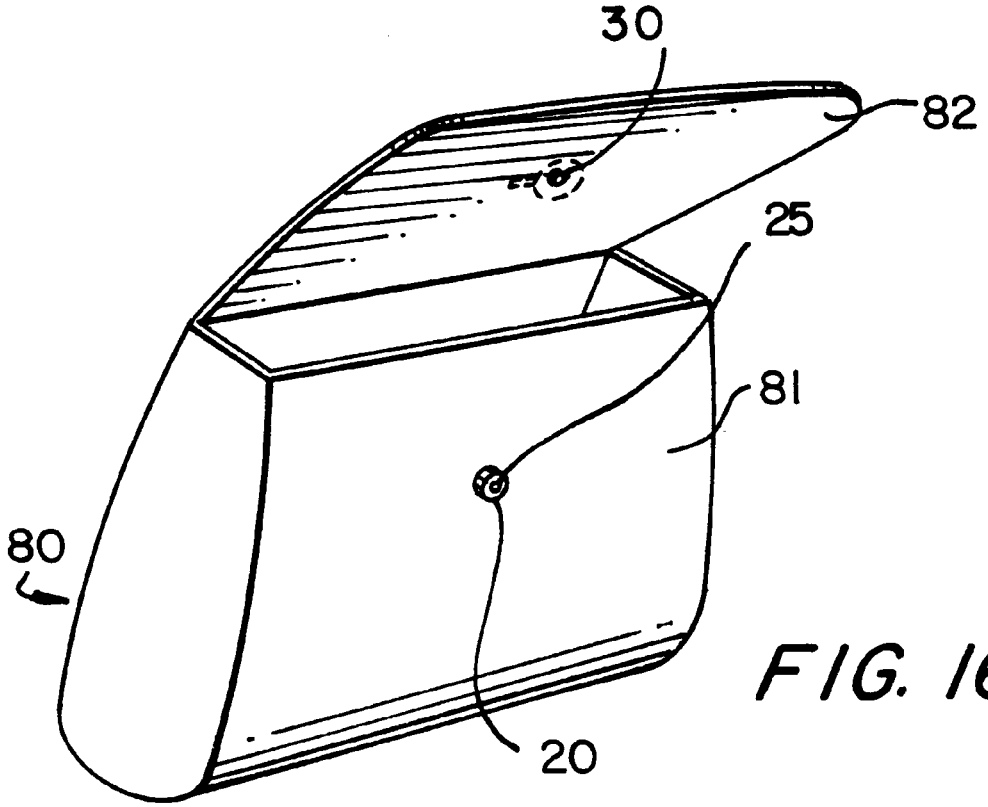

Reference is now made to FIGS. 16 and 16A which illustrate a typical use of the locking magnetic fastener of the present invention. The male assembly 20 is mounted to one of the sides 81 of the handbag 80. The female assembly 30 is mounted to the flap member 82 of the handbag. Accordingly, when the handbag is closed the projecting ferromagnetic male member 25 will cooperatively engage the female assembly 30, resulting in the condition shown in FIG. 1. To release this locking engagement, the slide 60, which will be exteriorly accessible, is then moved, to disengage the mechanical lock between surfaces 27, 45 (see FIG. 1) thereby permitting the flap to be open to the condition shown in 15A.

It should therefore be appreciated that the present invention provides for a very simple, low cost magnetic fastener including a manually defeatable slide lock. Except for the permanent magnet 32, and cooperating male member 25, all the other parts may be formed of nonferromagnetic material, with a zinc-lead alloy of brass being preferred. The female housing members 40, 50, 70, and 75 are selected to provide appropriate magnetic shielding for the permanent magnet 32. It should however be understood that a variety of alternative materials may be utilized. For example, the exterior decorative cover 75 may be formed of plastic, which may include flux blocking particles, typically zinc or a zinc nickel composite to increase the magnetic insulation.

Accordingly, while the present invention has been disclosed with reference to specific preferred embodiments, and particulars thereof, it is intended that the invention be defined by the following claims.

I claim:

1. A magnetic fastener including manually separable male and female assemblies;

said female assembly including a permanent magnet freely slidable within an interior chamber;

said male assembly including a projecting ferromagnetic member, the forward end of said male assembly including a cam surface;

said female assembly including an exterior aperture for receiving said ferromagnetic member, said exterior aperture communicating with said interior chamber, such that said permanent magnet moves into magnetic attraction with said ferromagnetic member as said ferromagnetic member enters said interior chamber;

said permanent magnet including a cam follower surface which initially engages said cam surface at the forward end of said ferromagnetic member, said cam follower surface operatively configured to laterally move said permanent magnet away from said ferromagnetic member, in opposition to their magnetically induced attractive forces, as said cam surface moves along said cam follower surface during the continued entry of said ferromagnetic member into said interior chamber, lock means at the termination of the cam engagement between said ferromagnetic member and permanent magnet for mechanically retaining said ferromagnetic member within the interior chamber of said female assembly, and lock release means for manually releasing said lock means.

2. The magnetic fastener of claim 1, wherein, said lock means includes an undercut at the terminus of said cam surface to permit said permanent magnet to reverse its lateral movement and slide towards said ferromagnetic member.

3. The magnetic fastener of claim 2, wherein, said permanent magnet includes an annular shoulder for seating said undercut, the engagement of said undercut and shoulder preventing the removal of said ferromagnetic member from said female assembly.

4. The magnetic fastener of claim 1, wherein said lock release means includes a slide lever for moving said permanent magnet away from said ferromagnetic member.

5. The magnetic fastener of claim 3, wherein, said lock release means includes a slide lever for moving said permanent magnet away from said ferromagnetic member and defeating the engagement between said undercut and shoulder.

6. The magnetic fastener of claim 4, wherein said slide lever includes, a first handle portion extending outward of said female assembly, and a second actuating portion within said interior chamber, and in contact with said permanent magnet.

7. The magnetic fastener of claim 1, wherein said female assembly includes a non magnetic housing about said permanent magnet.

8. The magnetic fastener of claim 1, said female assembly fastener including magnetic shielding material about said permanent magnet.

9. The magnetic fastener of claim 1, wherein both said projecting ferromagnetic member of said male assembly and exterior aperture of said female assembly are circular.

10. The magnetic fastener of claim 9, wherein said lock means includes an undercut at the terminus of said cam surface to permit said permanent magnet to reverse its lateral movement and slide towards said ferromagnetic member;

said permanent magnet includes an annular shoulder for seating said undercut, the engagement of said undercut and shoulder preventing the removal of said ferromagnetic member from said female assembly; and said engagement is over at least half the circumference of said undercut.

11. The magnetic fastener of claim 10, wherein said engagement is generally C-shaped.

12. A magnetic fastener including manually separable male and female assemblies;

said female assembly including a housing and a permanent magnet freely slidable within an interior chamber;

said housing providing a magnetic shield about said permanent magnet;

said male assembly including a projecting ferromagnetic member;

said female assembly including an exterior aperture for receiving said ferromagnetic member, said exterior aperture communicating with said interior chamber, such that said permanent magnet moves into magnetic attraction with said ferromagnetic member as said ferromagnetic member enters said interior chamber;

said permanent magnet including a surface which engages a cooperating surface of said male member to provide a lock means between said ferromagnetic member and permanent magnet for mechanically retaining said ferromagnetic member within the interior chamber of said female assembly, and lock release means for manually releasing said lock means.

13. The magnetic fastener of claim 12, wherein said lock release means includes a slide lever for moving said permanent magnet away from said ferromagnetic member.

14. The magnetic assembly of claim 12, wherein:

the forward end of said male assembly including a cam surface;

said permanent magnet includes a cam follower surface which initially engages said cam surface at the forward end of said ferromagnetic member, said cam follower surface operatively configured to laterally move said permanent magnet away from said ferromagnetic member, in opposition to their magnetically induced attractive forces, as said cam surface moves along said cam follower surface during the continued entry of said ferromagnetic member into said interior chamber;

said lock means includes an undercut at the terminus of said cam surface to permit said permanent magnet to reverse its lateral movement and slide towards said ferromagnetic member; and said permanent magnetic includes an annular shoulder for seating said undercut, the engagement of said undercut and shoulder preventing the removal of said ferromagnetic member from said female assembly.

15. The magnetic assembly of claim 14, wherein said female assembly housing includes upper and lower members, each formed of non-magnetic material.

16. The magnetic fastener of claim 15, wherein said lock release means includes a non-magnetic slide lever projecting outward of said female housing for moving said permanent magnet away from said ferromagnetic member and defeating the engagement between said undercut and shoulder.

17. A magnetic fastener including manually separable male and female assemblies;

said female assembly including a first member freely slidable within an interior chamber;

said male assembly including a projecting second member, the forward end of said second member including a detent;

one of said first or second members being a permanent magnet and the other of said first or second members being ferromagnetic;

said female assembly including an exterior aperture for receiving said second member, said exterior aperture communicating with said interior chamber, such that said first member moves into magnetic attraction with said second member as said forward end of said second member enters said interior chamber;

said second member including a locking surface which engages said detent at the forward end of said second member for mechanical locking engagement therebetween;

lock release means for manually releasing said mechanical locking engagement, and magnetic shielding means for magnetically shielding said permanent magnet.

18. The magnetic fastener of claim 17, wherein said first member is said permanent magnet, and said magnetic shielding means is provided by a non-magnetic housing of said female assembly which encloses said permanent magnet.

* * * * *